US008548876B1

(12) United States Patent
Fox et al.

(10) Patent No.: US 8,548,876 B1
(45) Date of Patent: Oct. 1, 2013

(54) AUTOMATIC SELECTION OF PRODUCT CATEGORIES FOR MERCHANDISING

(75) Inventors: Eric B. Fox, Seattle, WA (US); Logan Luyet Dillard, Seattle, WA (US)

(73) Assignee: Amazon Technologies, Inc., Reno, NV (US)

( * ) Notice: Subject to any disclaimer, the term of this patent is extended or adjusted under 35 U.S.C. 154(b) by 160 days.

(21) Appl. No.: 13/175,046

(22) Filed: Jul. 1, 2011

(51) Int. Cl.
*G06Q 30/00* (2012.01)

(52) U.S. Cl.
USPC ..... 705/26.7; 705/26.1; 705/26.62; 705/27.1; 705/14.1; 705/7.29; 705/7.31; 705/7.32

(58) Field of Classification Search
USPC ..... 705/26.1, 26.62, 26.7, 27.1, 14.1, 705/7.29, 7.31, 7.32
See application file for complete search history.

(56) References Cited

U.S. PATENT DOCUMENTS

| | | | | |
|---|---|---|---|---|
| 7,827,054 | B2 * | 11/2010 | Campbell et al. | 705/7.32 |
| 2002/0095411 | A1 * | 7/2002 | Caldwell et al. | 707/5 |
| 2007/0055579 | A1 * | 3/2007 | Ha | 705/26 |
| 2008/0052275 | A1 * | 2/2008 | Kantak et al. | 707/3 |
| 2008/0082499 | A1 * | 4/2008 | Koski | 707/3 |
| 2009/0327044 | A1 * | 12/2009 | Zhang et al. | 705/10 |
| 2010/0082410 | A1 * | 4/2010 | Baudin et al. | 705/10 |
| 2010/0262472 | A1 * | 10/2010 | Gautam et al. | 705/14.1 |

* cited by examiner

*Primary Examiner* — Yogesh C Garg
(74) *Attorney, Agent, or Firm* — Thomas |Horstemeyer, LLP

(57) ABSTRACT

Disclosed are various embodiments for selecting a subset of categories of product items to be used in merchandising. The subset of categories may be selected on a basis of a measured level of interest in the product items. Based on the subset of subcategories that have been selected, merchandising presentations may be automatically formulated and presented to a customer.

20 Claims, 8 Drawing Sheets

NUMBER OF VISITS

| | DISPLAY TYPE | # |
|---|---|---|
| 1. | LCD | 113456 |
| 2. | LED-LIT | 103889 |
| 3. | PLASMA | 99524 |
| 4. | PROJECTION | 75668 |
| 5. | CRT | 25100 |

FIG. 4

AUTOMATIC SELECTION OF PRODUCT CATEGORIES FOR MERCHANDISING

BACKGROUND

In retail environments, customers often have a general idea of what they want (e.g., a baby stroller) but need help figuring out which type or brand of the product they should purchase. Accordingly, customers might need advice in selecting a subcategory (e.g., product category, brand, or price range) or subgrouping of the product in which to focus their attention. As such, online and offline merchandisers often create displays that highlight the relevant subcategories of products. These displays typically are created manually by experts with domain expertise and/or are arbitrarily created for use with a wide variety of products in different product categories.

BRIEF DESCRIPTION OF THE DRAWINGS

FIG. 4 is a chart diagram that provides an example illustration of a ranking of categories based on a tracked metric according to various embodiments of the present disclosure.

DETAILED DESCRIPTION

The present disclosure relates to merchandising in an online retail establishment. Various embodiments of the present disclosure automatically select a subset of categories or subcategories for presentation to interested customers. The selected subset or category grouping aims to be intelligent in that it represents categories of product items deemed to be interesting to customers based on a tracked metric, such as available sales data. From a pool of possible categories, various embodiments will select a subset of categories and present them for viewing to interested customers over other possible categories.

Figure 1:
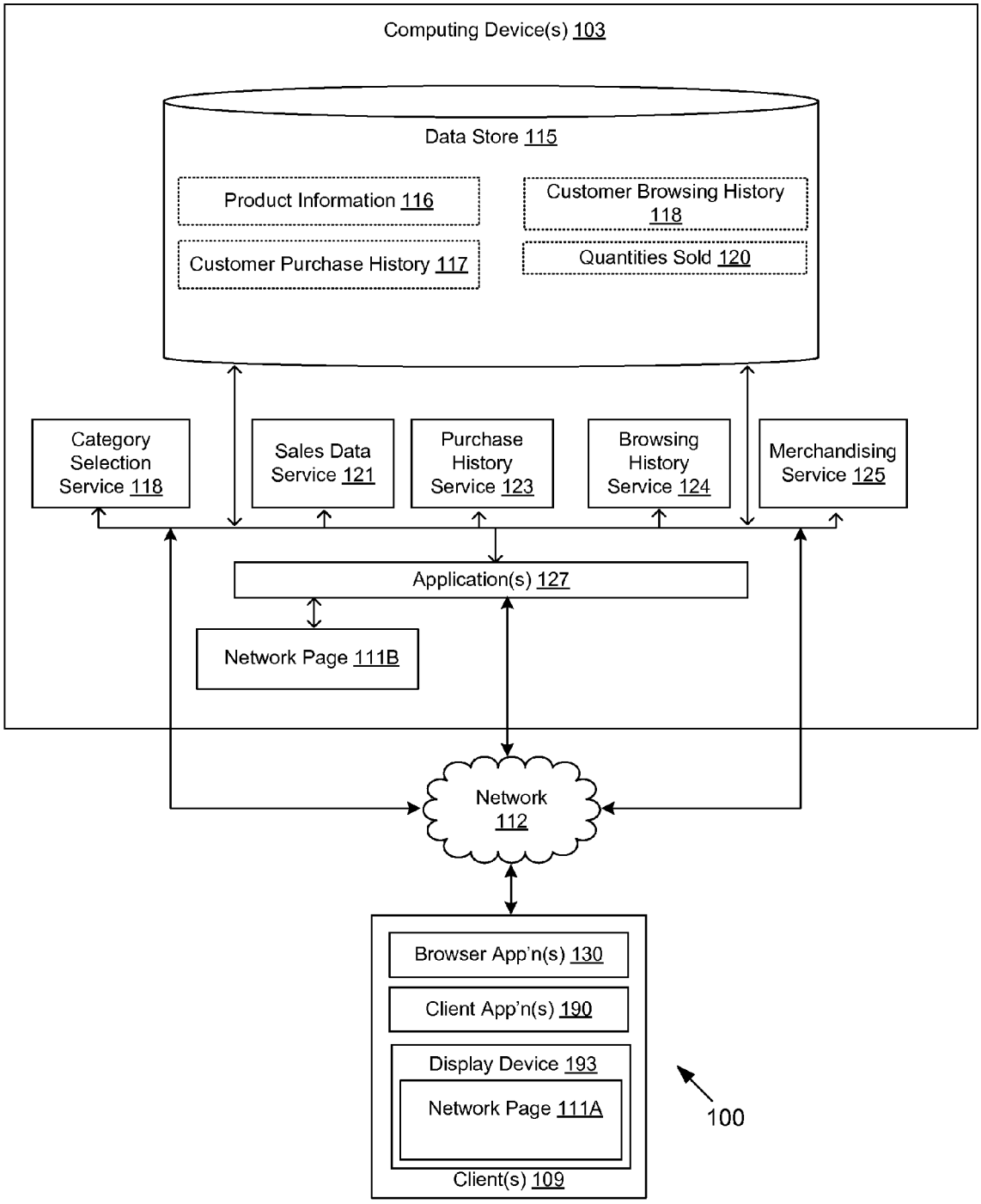
FIG. 1 is a drawing of a networked environment according to various embodiments.

With reference to FIG. 1, shown is a networked environment 100 according to various embodiments. The networked environment 100 includes one or more computing devices 103 in data communication with one or more clients 109 by way of a communication network 112. The network 112 includes, for example, the Internet, intranets, extranets, wide area networks (WANs), local area networks (LANs), wired networks, wireless networks, or other suitable networks, etc., or any combination of two or more such networks.

The computing device 103 may comprise, for example, a server computer or any other system providing computing capability. Alternatively, a plurality of computing devices 103 may be employed that are arranged, for example, in one or more server banks or computer banks or other arrangements. For example, a plurality of computing devices 103 together may comprise a cloud computing resource, a grid computing resource, and/or any other distributed computing arrangement. Such computing devices 103 may be located in a single installation or may be distributed among many different geographical locations. For purposes of convenience, the computing device 103 is referred to herein in the singular. Even though the computing device 103 is referred to in the singular, it is understood that a plurality of computing devices 103 may be employed in the various arrangements as described above.

Various applications and/or other functionality may be executed in the computing device 103 according to various embodiments. Also, various data is stored in a data store 115 that is accessible to the computing device 103. The data store 115 may be representative of a plurality of data stores as can be appreciated. The data stored in the data store 115, for example, is associated with the operation of the various applications and/or functional entities described below.

The components executed on the computing device 103, for example, include a category selection service 118, a sales data service 121, a purchase history service 123, a browsing history service 124, a merchandising service 125, and other applications 127, services, processes, systems, engines, or functionality not discussed in detail herein. The category selection service 118 is executed to select categories or groupings of product items from a pool of available categories that are determined based on how respective categories are ranked in accordance with particular criteria such as sales data or customer data. The sales data service 121 is executed to accept characteristics or feedback on the product items (e.g., sales data, ratings data, etc.) that may be used to rank categories in an order that can be used to select a subset of categories for presentation to an interested customer. The purchase history service 123 is executed to retrieve and analyze a customer's purchase history, whereby this information may be used to rank categories in an order that can be used to select a subset of categories for presentation to an interested customer. The browsing history service 124 is executed to retrieve and analyze a customer's browsing habits and history, whereby this information may be used to rank categories in an order that can be used to select a subset of categories for presentation to an interested customer. The merchandising service 125 is executed to promote one or more product items being sold on the online retail establishment with presentation of the selected categories or groupings for the one or more product items. The presentation is intended to stimulate interest in making a purchase of the one or more product items by a customer.

The applications 127 correspond to hosted applications that may access the data stored in the online retail establishment. Various applications 127 may, for example, have a web-based interface and may serve up network pages 111 (e.g., 111A, 111B, 111C (FIG. 2), 111D (FIG. 5)), such as web pages or other forms of network content, to facilitate user interaction. Other applications 127 may include internal applications that may not have a web-based interface. Non-limiting examples of applications 127 may include data mining programs, statistical analysis programs, and so on.

The data stored in the data store 115 includes, for example, product information 113 including product prices, product model numbers, product descriptions, product categories, product features, etc., and potentially other data including customer purchase history 114, customer browsing history 115, and sales metrics such as quantities sold 117 for particular products among others.

The client 109 is representative of a plurality of client devices that may be coupled to the network 112. The client 109 may comprise, for example, a processor-based system such as a computer system. Such a computer system may be embodied in the form of a desktop computer, a laptop computer, a personal digital assistant, a cellular telephone, a set-top box, music players, web pads, tablet computer systems, game consoles, or other devices with like capability. The client 109 may also include, for example various peripheral devices. In particular, the peripheral devices may include input devices such as, for example, a keyboard, keypad, touch pad, touch screen, microphone, scanner, mouse, joystick, or one or more push buttons, etc.

The client 109 may be configured to execute various applications such as a browser application 130 and/or other client applications 190. The browser application 130 and/or client applications 190 are configured to interact with the computing device 103 and related applications on the computing device 103 according to an appropriate protocol such as the Internet Protocol Suite comprising Transmission Control Protocol/Internet Protocol (TCP/IP) or other protocols. To this end, the browser application 130 may comprise, for example, a commercially available browser such as INTERNET EXPLORER® sold by Microsoft Corporation of Redmond, Wash., or MOZILLA FIREFOX® which is promulgated by Mozilla Corporation of Mountain View, Calif., or other type of browser. Alternatively, the browser application 130 may comprise some other application with like capability.

When executed in the client 109, the browser application 130 renders network pages 111A on the display device 193. Network pages 111A indicating content regarding product items in an online retail establishment can include one or more merchandizing presentations(s), including breakdowns of product items into categories and/or subcategories, to the user.

Figure 2:
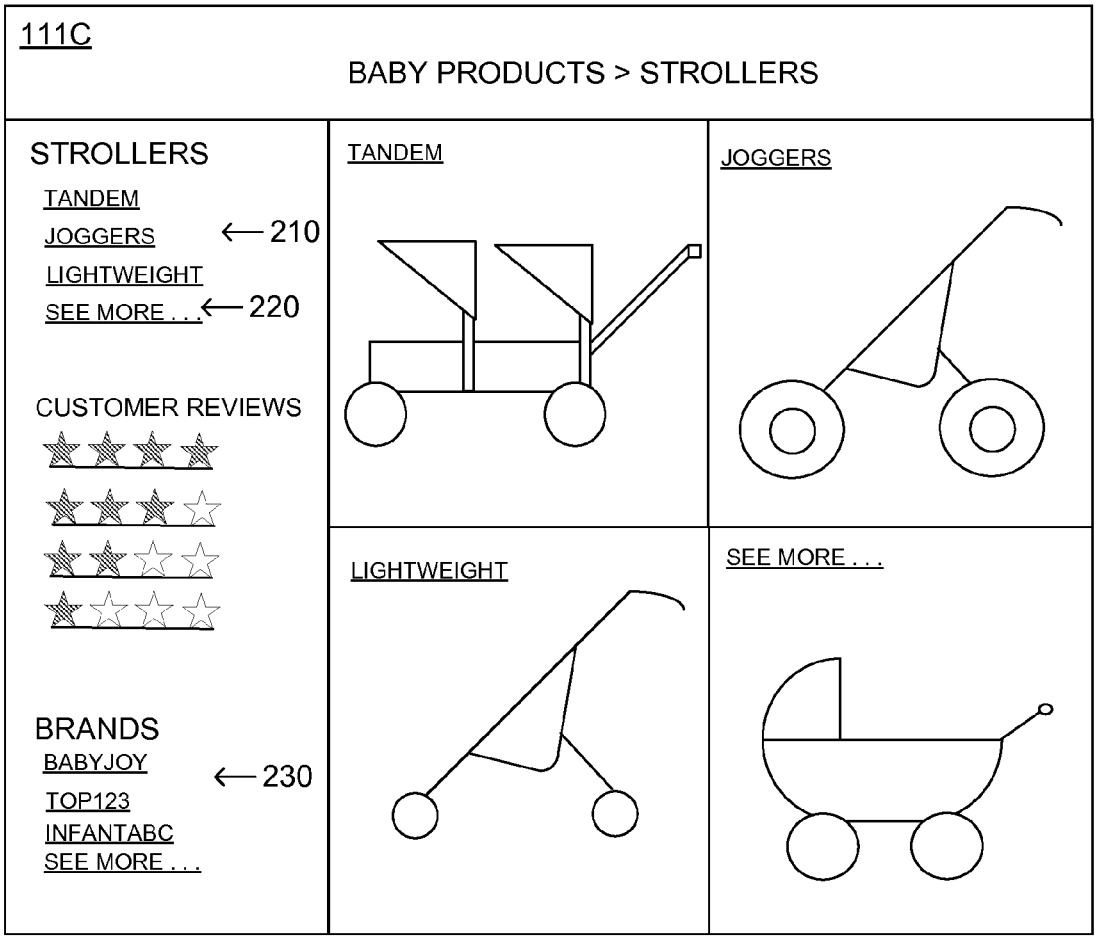
FIG. 2 is a diagram illustrating a network page showing a representation of subcategories of products in a product category according to various embodiments of the present disclosure.

Next, a general description of the operation of the various components of the networked environment 100 is provided. To begin, a user or customer may view a network page 111 (111A, 111B, 111C (FIG. 2), 111D (FIG. 5)) of an online retail establishment via a client 109. The network page 111B is provided by the computing device 103. For example, as depicted in FIG. 2, a network page 111C may provide the customer with an option to select a category of product items to browse. Accordingly, the customer may input or select the category of "baby strollers." After receiving the selection from the customer, the computing device 103 provides the customer with a network page to a storefront of the baby stroller department of the online retail environment. This network page 111C provides additional options for the customer to choose from including subcategories of baby strollers that may be of interest to the customer. In one embodiment, the subcategories 210 are different types of baby strollers, namely Tandem, Joggers, and Lightweight. While there may be more subcategories of baby strollers besides these three, the network page 111C, in one embodiment, may only show three of the subcategories at a time, possibly to not clutter the page or to overwhelm a customer. The subcategories 210 shown on the network page 111C are selected from the many possible subcategories, by the category selection service 118, based on available data (e.g., number of units sold, revenue data, etc.) that is used to rank and identify the most interesting subset of categories according to a designated number (e.g., 3). For example, product items in the Tandem, Joggers, and Lightweight categories may have outsold other product items in other baby stroller categories such as prams (or baby carriages) and travel strollers. Accordingly, they may be deemed to be of more current interest to customers, in general.

Therefore, the merchandising service 125 (FIG. 1) may include the selected categories of product items in a network page 111C to a storefront of the baby stroller department of the online retail environment. In one embodiment, the selected categories are to be provided as selectable categories (e.g., hyperlinks) in a navigation pane of the network page 111C that direct the customer to a network page dedicated to a category, when the category is selected by the customer from the navigation pane.

Such a process automatically selects groupings of product items for presentation based on data reflective of user-interest in the constituent product items and not based on what may be dated designations by a merchandiser. Categories of product items not selected for viewing on the network page 111C may be accessed by selecting a "See More" option 220 that will allow the customer to view additional categories that are not being presented on the page 111C. In addition, additional sets of categories 230, including different brands, of product items displayed on network page 111C may also be selected in accordance with one or more embodiments of the present disclosure.

Figure 3:
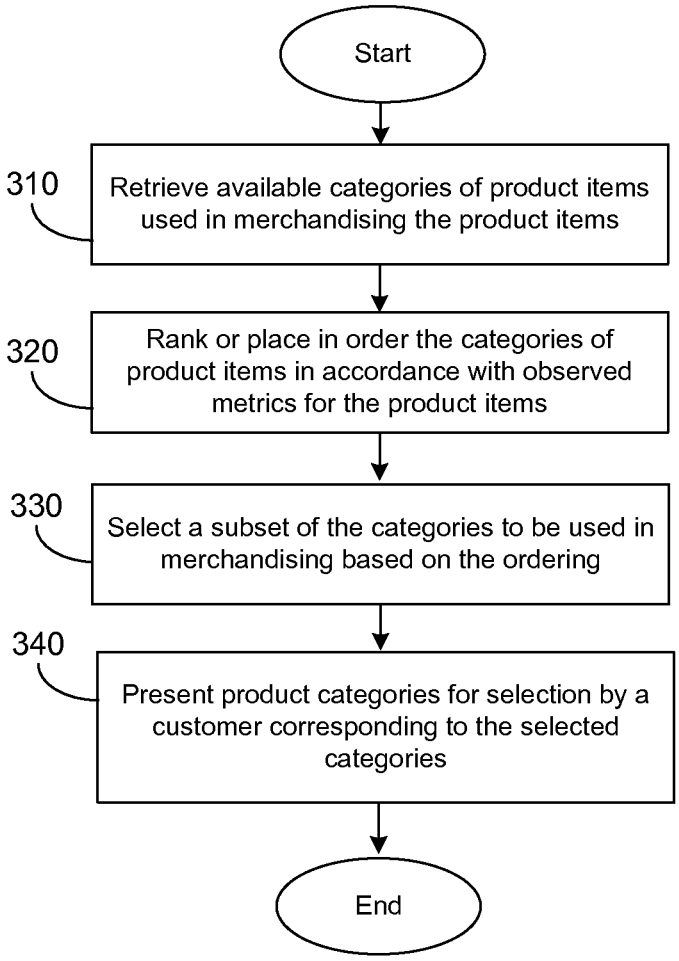
FIG. 3 is a flowchart illustrating one example of functionality implemented as portions of a category selection service executed in a computing device in the networked environment of FIG. 1 according to various embodiments of the present disclosure.

Referring next to FIG. 3, shown is a flowchart that provides one example of the operation of a portion of the category selection service 118 (FIG. 1) according to various embodiments. It is understood that the flowchart of FIG. 3 provides merely an example of the many different types of functional arrangements that may be employed to implement the operation of the portion of the category selection service 118 (FIG. 1) as described herein. As an alternative, the flowchart of FIG. 3 may be viewed as depicting an example of steps of a method implemented in the computing device 103 (FIG. 1) according to one or more embodiments.

Beginning with box 310, the category selection service 118 (FIG. 1) retrieves the available categories of product items used in merchandising the product items to customers. In box 320, the category selection service 118 (FIG. 1) ranks or orders the categories of product items in accordance with observed or tracked metrics for the product items. In this example, the metrics are statistics on how many units of the product items have been sold in a certain period of time. Therefore, the category selection service 118 (FIG. 1) determines how many units of product items have been sold with respect to each category and then orders the categories from the highest number of units sold per category to the least number of units sold per category.

Then, in box 330, the category selection service 118 (FIG. 1) selects a subset of the categories to be used in merchandising based on the ordering of the categories and the merchandising service 125 (FIG. 1) presents product categories available for selection by a customer corresponding to the subset of categories selected by the category selection service, in box 340. Based on how often the metric-related data is updated, new categories may be selected based on the underlying data used to rank or order the categories of product items. This update of the selected categories may be automatically triggered by a notification or detection of the updating of the underlying data or metric(s).

Consider that often in today's retail establishments, product items are grouped into different categories and a person referred to as a "merchandiser" picks the categories he or she believes will be of most interest to customers and will lead to the most sales based on the merchandiser's experience and research. In contrast, various embodiments of the present disclosure automatically select a subset of the categories/subcategories of product items used in merchandising for many departments of product items without involvement of the merchandiser addressing each individual department, category, and subcategory of product items.

As an example, possible categories of product items include different brands of product items, best sellers, top rated product items, most gifted product items, most wished for product items, new releases, etc., where a subset of product items are listed or grouped under respective categories. Therefore, the category selection service 118 (FIG. 1) could select to present the best sellers option, the top rated product items option, and the new releases option in a scenario where only three categories are to be presented and these are determined to be the most interesting of the available categories for merchandising purposes. Further, under a respective category, subcategories may also be selected for presentation to the user or customer. To illustrate, regarding the brands category, it may be comprised of multiple subcategories of individual brands. For example, consider a scenario where a product category is televisions and the top four selling televisions are brands Acme, Star, Dazzler, and ABC. Therefore, these four brands (or some other desired number of brands) may be selected to be presented on a network page 111 of television product items as opposed to other brands of television product items. Accordingly, within the subcategory for the brand Acme, product items having the Acme brand are grouped. These are but possible implementations and in certain embodiments, different categories of products may be utilized, such as those involving groupings for product features, product terms, price bands or ranges, etc.

Referring now to FIG. 4, a chart is shown ranking categories of product items. In this example, the categories are ranked on the basis of a number of visits or "clicks" to network pages for the product items within the respective categories. In this example, the product items are televisions and display subcategories for within the television product items comprise LCD, Plasma, Projection, CRT, LED-Lit, among others. The chart shows that the top-ranked categories, on the basis of the number of visits pages dedicated to the categories have received, are 1) LCD 2) LED-Lit 3) Plasma 4) Projection 5) CRT. Accordingly, in a scenario where the merchandising service 125 (FIG. 1) needs to select two categories, the merchandising service 125 (FIG. 1) will select the LCD and LED-Lit subcategories using this basis (i.e., number of visits), since these are the top two subcategories. Using a different basis (e.g., ranking on basis of best sellers), the ordering of display categories may change.

Figure 5:
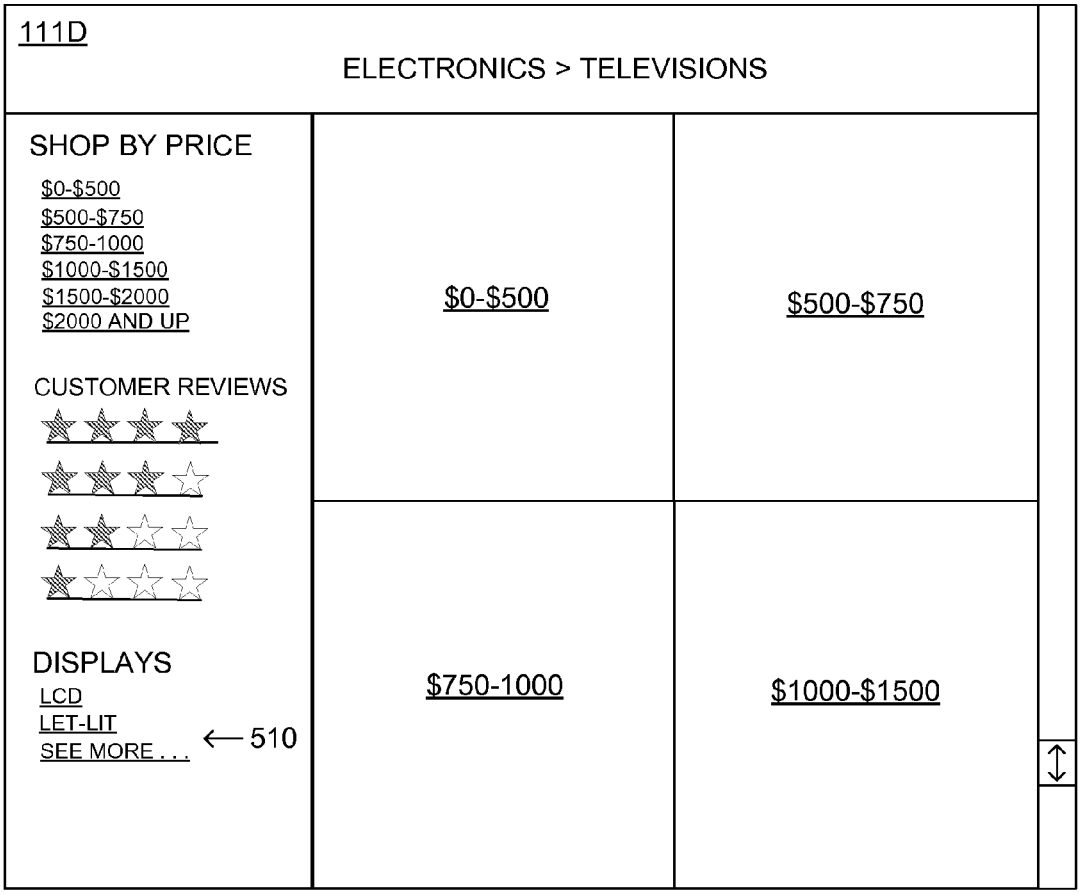
FIG. 5 is a diagram illustrating a network page showing a representation of subcategories of products in a product category according to various embodiments of the present disclosure.

Accordingly, as shown in FIG. 5, a network page 111D may provide the user or customer an option to select a category of television product items to browse, where the category is chosen based on the ranking of FIG. 4. Network page 111D provides options for the customer to choose from including television product items categorized by display types. In one embodiment, the categories 510 are the top ranked categories from FIG. 4. Accordingly, in a scenario where the merchandising service 125 (FIG. 1) needs to select two categories, the merchandising service 125 (FIG. 1) selects the LCD and LED-Lit categories 510 using this basis (i.e., number of visits). Using a different basis (e.g., ranking on basis of best sellers), the selection of display categories may therefore be different.

Figure 6:
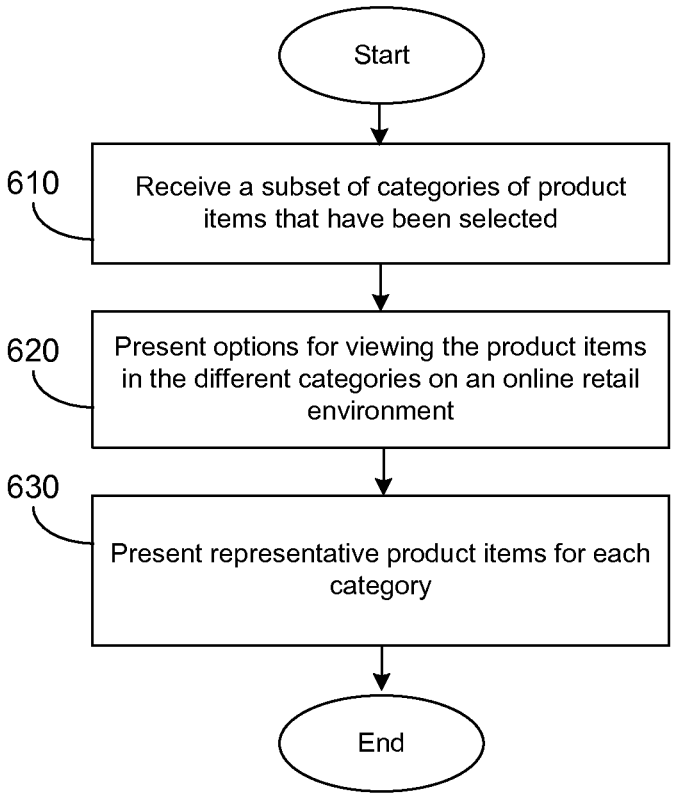
FIGS. 6-7 are flowcharts illustrating examples of functionality implemented as portions of a merchandising service executed in a computing device in the networked environment of FIG. 1 according to various embodiments of the present disclosure.

Referring next to FIG. 6, shown is a flowchart that provides one example of the operation of a portion of the merchandising service 125 (FIG. 1) according to various embodiments. Beginning with box 610, the merchandising service 125 (FIG. 1) receives a subset of product categories selected by the category selection service 118, where a product category has one or more product items grouped under it. In box 620, the merchandising service 125 (FIG. 1) presents options for viewing product items in the product category in accordance with the categories selected by the category selection service 118. Further, in various embodiments, the merchandising service 125 (FIG. 1) presents representative product items for each category, in box 630, so that a conscientious customer, as an example, can more easily gauge a type of product item that is represented by a category.

In one embodiment, upon reviewing product items belonging to a selected category of products (that was presented in the subset), a customer may select a particular product item and add the product item to a virtual shopping cart of the retail website. The customer may then implement the purchase of the product item by navigating through an appropriate checkout type of pipeline or other checkout process for the retail website.

Figure 7:
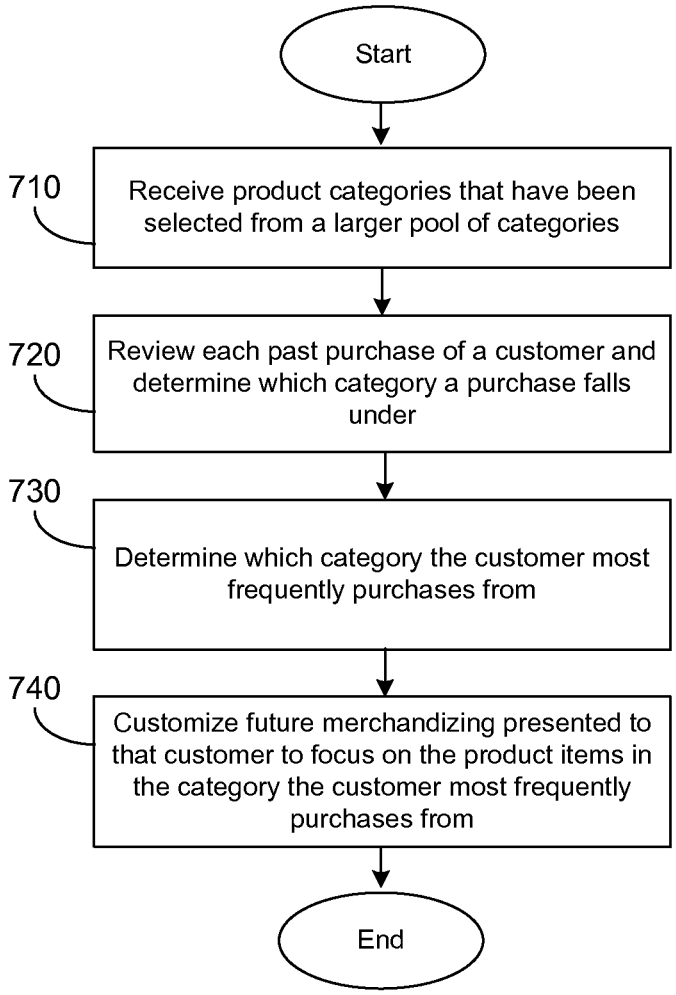

Referring next to FIG. 7, shown is a flowchart that provides one example of the operation of a portion of the merchandising service 125 (FIG. 1) and related services according to various embodiments. Beginning with box 710, the merchandising service 125 (FIG. 1) receives product categories selected by the category selection service 118 (FIG. 1). For example, the categories may comprise brands of product items, among other possibilities. For a particular customer, the purchase history service 123 (FIG. 1) reviews each past purchase of the customer and determines if the customer has purchased any product items of any of the categories (e.g., brands), as shown in box 720. Then, in box 730, the purchase history service 123 (FIG. 1) analyzes the past customer purchases and determines which category (e.g., a particular brand) of product items, if any, the customer most frequently purchases and/or determines a ranking or ordering of the categories based on the number of past purchases of products belonging to the particular categories. The merchandising service 125 (FIG. 1) receives this determination and customizes future merchandizing presented to that customer, as shown in box 740. For example, if it is determined that a given customer typically purchases baby items of brands Babyjoy, Top123, and InfantABC, the merchandising service 125 (FIG. 1) may modify future merchandising for that customer to highlight or focus on product items from brands Babyjoy, Top123, and InfantABC as opposed to focusing on product items from brands that the customer has no track record of using or buying or browsing.

In various embodiments, the purchase history service 123 (FIG. 1) may consider separately purchases from each category. For example, the purchase history service 123 (FIG. 1) may determine that a particular customer tends to buy stereo equipment from brand RadioStar, but television equipment from a competitor VideoStar. Also, the browsing history service 124 (FIG. 1) may consider which price band or category a customer frequently views or visits and use this information as a basis to customize future merchandising, as generally described above. As an example, the customer's browsing and/or purchasing history may be used to determine a customer's interest and thereby used to help select interesting categories of product items that are presented to the customer on a retail website. In various embodiments, a provider of the retail website, a merchant, or product manufacturer may designate which metric is used to rank the categories. For example, for computer laptops, product ratings may be considered to be important and desired to be used to rank and select laptop categories, whereas for kitchen blenders, best-selling metrics may be considered to be most important and desired to be used to rank and select blender categories. Accordingly, the underlying data used to rank categories may be selectable by interested parties, including a retail website provider, a merchant, or product manufacturer.

The merchandising service 125 (FIG. 1) can suggest product categories even when there is no available purchase history or browsing history for the customer. For example, consider a customer that is just beginning to shop for a Blu-ray disc player. The purchase history service 123 (FIG. 1) would initially not have any useful data about this customer's preference for Blu-ray disc players to review. But, by reviewing the customer's purchase history for electronics in general, where an electronics category is a superset of the Blu-ray disc player category, the purchase history service 123 (FIG. 1) can determine that the customer generally buys from brand or manufacturer VideoStar in electronics and therefore conclude that the customer will be most interested in Blu-ray disc players under the VideoStar brand. Accordingly, the merchandising service 125 (FIG. 1) can target its merchandising as such to the customer. Therefore, by using automated category selection in combination with a customer's recent purchase history data, a predicted desired offering of product categories may be provided to the customer.

Figure 8:
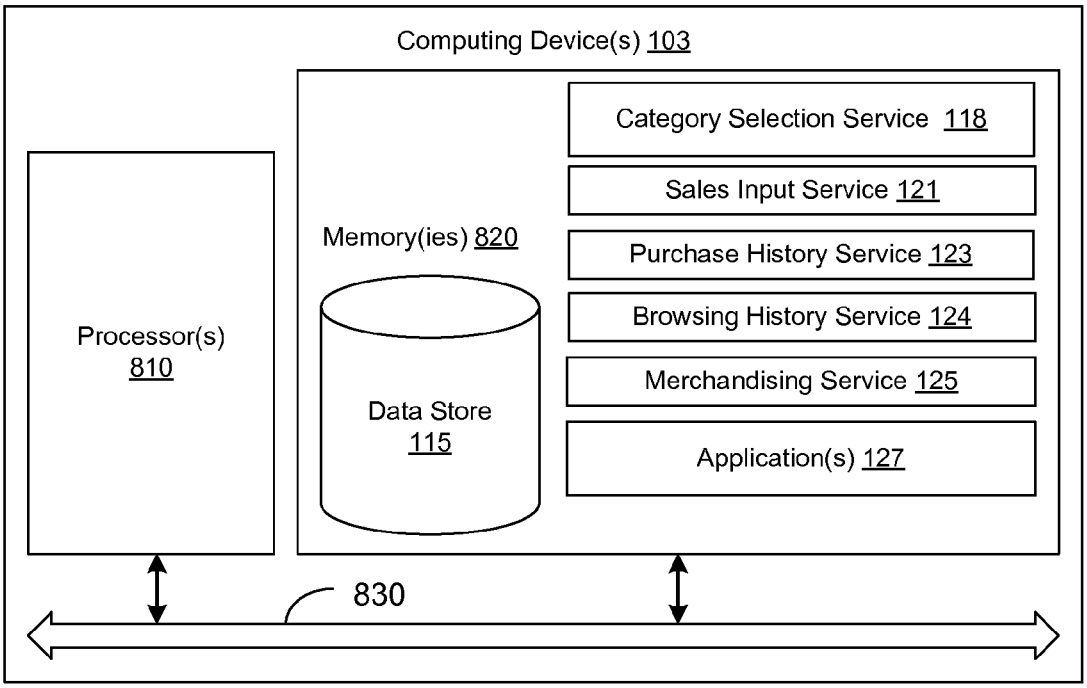
FIG. 8 is a schematic block diagram that provides one example illustration of a computing device employed in the networked environment of FIG. 1 according to various embodiments of the present disclosure.

With reference to FIG. 8, shown is a schematic block diagram of the computing device 103 according to an embodiment of the present disclosure. The computing device 103 includes at least one processor circuit, for example, having a processor 810 and a memory 820, both of which are coupled to a local interface 830. To this end, the computing device 103 may comprise, for example, at least one server computer or like device. The local interface 830 may comprise, for example, a data bus with an accompanying address/control bus or other bus structure as can be appreciated.

Stored in the memory 820 are both data and several components that are executable by the processor 810. In particular, stored in the memory 820 and executable by the processor 810 are the category selection service 118, sales data service 121, purchase history service 123, browsing history service 124, merchandising service 125, and potentially other applications. Also stored in the memory 820 may be a data store 115 and other data. In addition, an operating system may be stored in the memory 820 and executable by the processor 810.

It is understood that there may be other applications that are stored in the memory 820 and are executable by the processors 810 as can be appreciated. Where any component discussed herein is implemented in the form of software, any one of a number of programming languages may be employed such as, for example, C, C++, C#, Objective C, Java, Javascript, Perl, PHP (Hypertext preprocessor), Visual Basic, Python, Ruby, Delphi, Flash, or other programming languages.

A number of software components are stored in the memory 820 and are executable by the processor 810. In this respect, the term "executable" means a program file that is in a form that can ultimately be run by the processor 810. Examples of executable programs may be, for example, a compiled program that can be translated into machine code in a format that can be loaded into a random access portion of the memory 820 and run by the processor 810, source code that may be expressed in proper format such as object code that is capable of being loaded into a random access portion of the memory 820 and executed by the processor 810, or source code that may be interpreted by another executable program to generate instructions in a random access portion of the memory 820 to be executed by the processor 810, etc. An executable program may be stored in any portion or component of the memory 820 including, for example, random access memory (RAM), read-only memory (ROM), hard drive, solid-state drive, USB (Universal Serial Bus) flash drive, memory card, optical disc such as compact disc (CD) or digital versatile disc (DVD), floppy disk, magnetic tape, or other memory components.

The memory 820 is defined herein as including both volatile and nonvolatile memory and data storage components. Volatile components are those that do not retain data values upon loss of power. Nonvolatile components are those that retain data upon a loss of power. Thus, the memory 820 may comprise, for example, random access memory (RAM), read-only memory (ROM), hard disk drives, solid-state drives, USB flash drives, memory cards accessed via a memory card reader, floppy disks accessed via an associated floppy disk drive, optical discs accessed via an optical disc drive, magnetic tapes accessed via an appropriate tape drive, and/or other memory components, or a combination of any two or more of these memory components. In addition, the RAM may comprise, for example, static random access memory (SRAM), dynamic random access memory (DRAM), or magnetic random access memory (MRAM) and other such devices. The ROM may comprise, for example, a programmable read-only memory (PROM), an erasable programmable read-only memory (EPROM), an electrically erasable programmable read-only memory (EEPROM), or other like memory device.

Also, the processor 810 may represent multiple processors 810 and the memory 820 may represent multiple memories 820 that operate in parallel processing circuits, respectively. In such a case, the local interface 830 may be an appropriate network 112 (FIG. 1) that facilitates communication between any two of the multiple processors 810, between any processor 810 and any of the memories 820, or between any two of the memories 820, etc. The local interface 830 may comprise additional systems designed to coordinate this communication, including, for example, performing load balancing. The processor 810 may be of electrical or of some other available construction.

Although the category selection service 118, sales data service 121, purchase history service 123, browsing history service 124, merchandising service 125, and other various systems described herein may be embodied in software or code executed by general purpose hardware as discussed above, as an alternative the same may also be embodied in dedicated hardware or a combination of software/general purpose hardware and dedicated hardware. If embodied in dedicated hardware, each can be implemented as a circuit or state machine that employs any one of or a combination of a number of technologies. These technologies may include, but are not limited to, discrete logic circuits having logic gates for implementing various logic functions upon an application of one or more data signals, application specific integrated circuits having appropriate logic gates, or other components, etc. Such technologies are generally well known by those skilled in the art and, consequently, are not described in detail herein.

The flowcharts of FIGS. 3, 6, and 7 show the functionality and operation of an implementation of portions of the subcategory selection service 118 and related applications. If embodied in software, each block may represent a module, segment, or portion of code that comprises program instructions to implement the specified logical function(s). The program instructions may be embodied in the form of source code that comprises human-readable statements written in a programming language or machine code that comprises numerical instructions recognizable by a suitable execution system such as a processor 1010 in a computer system or other system. The machine code may be converted from the source code, etc. If embodied in hardware, each block may represent a circuit or a number of interconnected circuits to implement the specified logical function(s).

Although the flowcharts of FIGS. 3, 6, and 7 show a specific order of execution, it is understood that the order of execution may differ from that which is depicted. For example, the order of execution of two or more blocks may be scrambled relative to the order shown. Also, two or more blocks shown in succession in FIGS. 3, 6, and 7 may be executed concurrently or with partial concurrence. Further, in some embodiments, one or more of the blocks shown in FIGS. 3, 6, and 7 may be skipped or omitted. In addition, any number of counters, state variables, warning semaphores, or messages might be added to the logical flow described herein, for purposes of enhanced utility, accounting, performance measurement, or providing troubleshooting aids, etc. It is understood that all such variations are within the scope of the present disclosure.

Also, any logic or application described herein, including the category selection service 118, sales data service 121, purchase history service 123, browsing history service 124, merchandising service 125, that comprises software or code can be embodied in any non-transitory computer-readable medium for use by or in connection with an instruction execution system such as, for example, a processor 810 in a computer system or other system. In this sense, the logic may comprise, for example, statements including instructions and declarations that can be fetched from the computer-readable medium and executed by the instruction execution system. In the context of the present disclosure, a "computer-readable medium" can be any medium that can contain, store, or maintain the logic or application described herein for use by or in connection with the instruction execution system. The computer-readable medium can comprise any one of many physical media such as, for example, magnetic, optical, or semiconductor media. More specific examples of a suitable computer-readable medium would include, but are not limited to, magnetic tapes, magnetic floppy diskettes, magnetic hard drives, memory cards, solid-state drives, USB flash drives, or optical discs. Also, the computer-readable medium may be a random access memory (RAM) including, for example, static random access memory (SRAM) and dynamic random access memory (DRAM), or magnetic random access memory (MRAM). In addition, the computer-readable medium may be a read-only memory (ROM), a programmable read-only memory (PROM), an erasable programmable read-only memory (EPROM), an electrically erasable programmable read-only memory (EEPROM), or other type of memory device.

It should be emphasized that the above-described embodiments of the present disclosure are merely possible examples of implementations set forth for a clear understanding of the principles of the disclosure. Many variations and modifications may be made to the above-described embodiment(s) without departing substantially from the spirit and principles of the disclosure. All such modifications and variations are intended to be included herein within the scope of this disclosure and protected by the following claims.

Therefore, the following is claimed:

1. A non-transitory computer-readable medium embodying a program executable in a computing device, the program comprising:

code that monitors transactions of product items offered for sale on a retail website across a plurality of tracked metrics, wherein a plurality of categories used in merchandising is associated with the product items and a subset of the product items is grouped under each category of the plurality of categories;

code that receives the plurality of categories used in merchandising associated with the product items offered for sale on the retail website;

code that receives a selection of at least one of the plurality of tracked metrics;

code that ranks the plurality of categories based on the selected at least one of the plurality of tracked metrics, wherein the selected at least one of the plurality of tracked metrics measures a level of interest by customers in the product items grouped under the plurality of categories;

code that automatically selects, based at least in part on the ranking of the plurality of categories, a subset of the plurality of categories that is determined to include product items that are of greater interest to customers than remaining categories that are not selected;

code that automatically formulates merchandising presentations based at least in part on the subset of categories that has been selected; and code that encodes for display at least one network page of the retail website having an option to view each of the subset of product subcategories that has been selected.

2. The computer-readable medium of claim 1, wherein the selected at least one of the plurality of tracked metrics comprises at least one of product ratings for the product items; amounts of product items sold; amounts of visits to web pages on the retail website dedicated to the product items; purchase history of a particular customer that is currently accessing the retail website; or browsing history on the retail website of a particular customer that is currently accessing the retail website.

3. The computer-readable medium of claim 1, wherein the plurality of categories comprise at least one of types of product items having similar product features or brands of the product items.

4. A system comprising:

a data store configured to store a plurality of tracked metrics; and at least one computing device in communication with the data store, the at least one computing device configured to at least: and monitor transactions of product items offered for sale on a retail website across the plurality of tracked metrics, wherein a plurality of subcategories used in merchandising is associated with a category of the product items and a subset of the product items is grouped under each subcategory of the plurality of subcategories;

receive a selection of one of a tracked metric from the plurality of tracked metrics;

rank the plurality of subcategories based at least in part on the selected tracked metric of the product items, wherein the tracked metric measures a level of interest by customers in the product items grouped under the plurality of subcategories;

automatically select, based at least in part on the ranking of the plurality of subcategories, a subset of the plurality of subcategories that is determined to include product items that are of greater interest to customers than remaining subcategories that are not selected, wherein a superset of product items is analyzed when the selected tracked metric is not available for the product items in the subcategory being considered and determinations made with respect to the superset of product items are attributed to the product items in the subcategory;

automatically formulate merchandising presentations based at least in part on the subset of the plurality of subcategories that has been selected; and encode for display at least one network page of the retail website having an option to view each of the subset of the plurality of subcategories that has been selected.

5. The system of claim 4, wherein the at least one computing device is further configured to:

select a particular product item from a subcategory in the subset of subcategories and add the product item to a virtual shopping cart of the retail website; and implement a purchase of the product item by navigating through a checkout process for the retail website.

6. The system of claim 4, wherein the merchandising presentations comprise a designated number of selectable subcategories of the product items that is provided in a navigation pane to direct the customer to network pages dedicated to a selected subcategory.

7. The system of claim 4, wherein the selected tracked metric comprises at least one of product ratings for the product items or amounts of product items sold.

8. The system of claim 4, wherein the selected tracked metric comprises amounts of visits to network pages on the retail website dedicated to the product items.

9. The system of claim 4, wherein the selected tracked metric comprises at least one of purchase history of a particular customer that is currently accessing the retail website or browsing history on the retail website of the particular customer that is currently accessing the retail website.

10. The system of claim 4, wherein the subcategories comprise at least one of types of product items having similar product features or price bands for the product items.

11. The system of claim 4, wherein the subcategories comprise brands of product items.

12. The system of claim 4, wherein the selected tracked metric measures a level of interest by customers in the product items and is preselected by at least one of a provider of the retail website, a merchant selling the product items, or a product manufacturer of the product items.

13. A method comprising:

monitoring customer transactions of product items offered for sale on a retail website across a plurality of tracked metrics, wherein a plurality of categories used in merchandising is associated with the product items and a subset of the product items is grouped under each category of the plurality of categories;

receiving, by a computing device, the plurality of categories associated with the product items offered for sale on the retail website;

receiving a selection of one of the plurality of tracked metrics;

ranking, by the computing device, the plurality of categories based on the selected tracked metric of the product items, wherein the selected tracked metric measures a level of interest by customers in the product items;

based at least in part on the ranking of the plurality of categories, automatically selecting, by the computing device, a subset of the plurality of categories that is determined to include product items that are of greater interest to customers than remaining categories that are not selected;

automatically formulating, by the computing device, merchandising presentations based at least in part on the subset of categories that has been selected; and encoding for display, by the computing device, at least one network page of the retail website having an option to view each of the subset of the plurality of categories that has been selected.

14. The method of claim 13, wherein the tracked metric comprises product ratings for the product items.

15. The method of claim 13, wherein the tracked metric comprises amounts of product items sold.

16. The method of claim 13, wherein the tracked metric comprises amounts of visits to network pages on the retail website dedicated to the product items.

17. The method of claim 13, wherein the tracked metric comprises purchase history of a particular customer that is currently accessing the retail website.

18. The method of claim 13, wherein the tracked metric comprises browsing history on the retail website of a particular customer that is currently accessing the retail website.

19. The method of claim 13, wherein the categories comprise at least one of types of product items having similar product features and price bands for the product items.

20. The method of claim 13, wherein the plurality of categories comprise brands of product items.

* * * * *